United States Patent [19]

Drapeau

[11] Patent Number: 4,635,424

[45] Date of Patent: Jan. 13, 1987

[54] ONE-PIECE FASTENER FOR SECURING A LINING ELEMENT IN A REMOVABLE MANNER ON A CARRYING SURFACE

[75] Inventor: Rémi Drapeau, Quebec, Canada

[73] Assignee: Les Enterprises Manuspec Inc., Quebec, Canada

[21] Appl. No.: 800,385

[22] Filed: Nov. 21, 1985

[30] Foreign Application Priority Data

Nov. 26, 1984 [CA] Canada ..... 468433

[51] Int. Cl.[4] ..... E04B 5/52

[52] U.S. Cl. ..... 52/480; 52/489; 52/510

[58] Field of Search ..... 52/489, 480, 483, 665, 52/484, 714, 309.1, 510

[56] References Cited

U.S. PATENT DOCUMENTS

| | | | |
|---|---|---|---|
| 3,005,293 | 10/1961 | Hunter | 52/489 X |
| 3,295,284 | 1/1967 | Tschiesche | 52/484 X |
| 4,193,230 | 3/1980 | Piana | 52/489 X |
| 4,245,446 | 1/1981 | Judkins | 52/484 X |
| 4,309,858 | 1/1982 | Anderle | 52/489 X |
| 4,356,677 | 11/1982 | Mosch | 52/489 |
| 4,432,182 | 2/1984 | Addie et al. | 52/480 |
| 4,494,346 | 1/1985 | Gailey | 52/489 |

FOREIGN PATENT DOCUMENTS 734140 5/1966 Canada .

OTHER PUBLICATIONS

Condensed Chemical Dictionary, 6th edition, 1956, Reinhold Publishing Co., p. 819.

*Primary Examiner*—Carl D. Friedman

*Attorney, Agent, or Firm*—Robic, Robic & Associates

[57] ABSTRACT

A one-piece fastener for securing a lining element in a removable and adjustable manner to a carrying surface which is to be lined or finished, such as a wall or a ceiling. This fastener is made of a thin plate having, on one face, at least one fastening tongue intended to be inserted into a corresponding groove provided on the lining element in order to secure and hold on to the latter. The plate has, on the other face, at least one set of teeth capable of simultaneously locking, in a reversible manner, by simple pressure on two parallel edges forming an integral part of a rail secured rigidly to the carrying surface to be lined or finished. The invention also relates to a system for removably securing a plurality of identical lining elements parallel to one another on a carrying surface, the said system comprising at least two rails capable respectively to receive two fasteners inserted through the ends of each lining elements to be secured.

9 Claims, 10 Drawing Figures

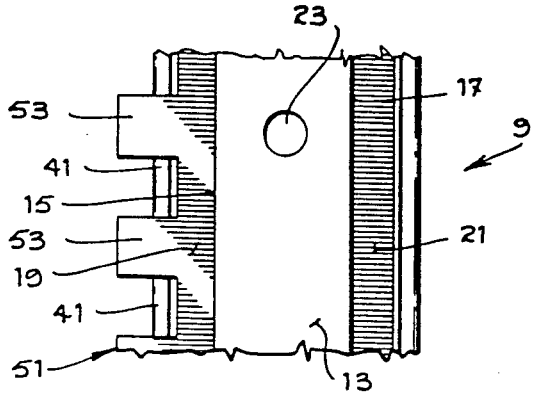
Fig. 4
Fig. 5
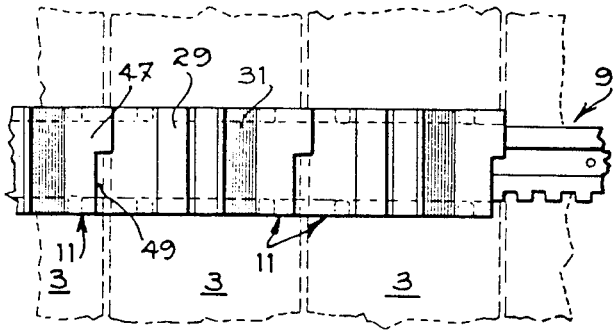
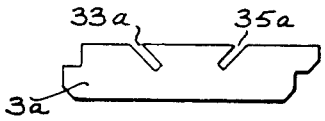
Fig. 6a
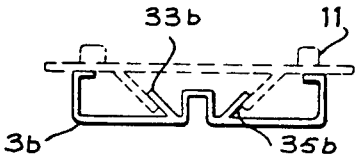
Fig. 6c
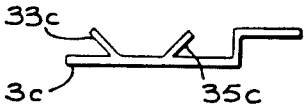
Fig. 6d
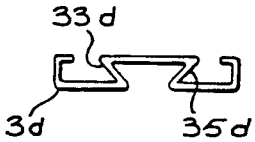
Fig. 6d

ONE-PIECE FASTENER FOR SECURING A LINING ELEMENT IN A REMOVABLE MANNER ON A CARRYING SURFACE

BACKGROUND OF THE INVENTION

1. Field of the Invention

The present invention relates to a one-piece fastener for securing a lining element in a removable and adjustable manner to a carrying surface intended to be lined or finished such as the walls or the ceiling of a room.

The invention also relates to a system for securing, removably, a plurality of identical parallel lining elements on a carrying surface, such as a wall or a ceiling, for lining and finishing the said surface in a simple and expeditious manner.

2. Description of the Related Art

The system usually used for lining a wall or a ceiling with a plurality of identical parallel lining elements such as wooden members, extruded plastic members or extruded aluminum members, consists in directly securing each of the elements by means of nails or screws to the carrying surface or to a plurality of wooden members secured to the surface to be lined, the latter wooden members acting as supports and spacers.

This well-known system has of course the advantage of simplicity. It has, however, two major disadvantages which frequently limit its use. The first one is that the lining elements, once secured, may not easily be removed or interchanged. In order to do so, it is indeed necessary to unscrew them one by one and then, again one by one, screw or nail the replacement elements. The other major disadvantage is that appropriate devices must be used to hide the heads of the screws or nails or other various means used for securing each of the lining elements to the carrying surface otherwise the appearance of the lining elements will be substantially affected.

SUMMARY OF THE INVENTION

The present invention proposes a lining system capable of avoiding the above two major disadvantages inasmuch as it allows, through its structure, securing the lining elements on a carrying surface in a manner which is not only simple but also removable.

The invention also lies in the provision of a one-piece fastener adapted to be used in the system according to the invention for securing a lining element in a removable and adjustable manner to the carrying surface intended to be lined or finished.

According to the invention, this one-piece fastener is characterized in that the fastener is a thin plate having, on one face thereof, at least one fastening tongue insertable into a corresponding groove of the lining element for securing and holding it. The thin plate also has, on the other face, means capable of reversibly locking the plate, by mere pressure on a rail which is rigidly fixed to the carrying surface to be lined or finished.

Preferably, two fastener tongues are provided which extend obliquely from the corresponding face of the plate in two opposite directions for insertion into two corresponding grooves provided on the lining element.

Likewise, the means capable of being locked onto the rail secured to the carrying surface to be lined or finished advantageously comprise at least one set of two teeth disposed and spaced from one another such as to allow simultaneous locking over two parallel edges forming integral parts of the rail.

According to a preferred embodiment of the invention, the thin plate advantageously has the form of a rectangle projecting lengthwise at either end to form integral positioning lugs which extend over only half the width of the plate and are staggered with respect to one another so that each lug may serve as reference and abutment for the precise positioning of an adjacent similar fastener over the same rail.

Preferably, the two fastening tongues extend transversely of the longitudinal axis of the plate over the full width thereof and are inclined toward one another. In this particular case, the means releasably locking on the rail by mere pressure comprise two pairs of teeth symmetrically disposed on either side of the rectangular plate so as to allow securing the plate at two points of the same rail in a position such that the longitudinal axis of the plate is aligned with that of the rail.

The system according to the invention for removably securing a plurality of identical parallel lining elements on a carrying surface for rapidly and simply lining or finishing the surface is characterized in that it comprises at least two rails intended to be rigidly fixed in parallel relation with the carrying surface to be lined or finished, each rail having two parallel edges defining two lines of support. The system also comprises a pair of fasteners such as previously described for each of the lining elements to be secured, the fasteners in question serving to secure the lining element corresponding thereto to both the rails by mere pressure locking of the respective pairs of teeth thereof on the parallel edges of the rails.

In such a system, each of the lining elements preferably comprises two oblique grooves extending over the full length thereof for the reception of the tongues of the fasteners corresponding thereto, the fastening tongues being inserted and located into the corresponding grooves of each lining element by fitting or by sliding of the fasteners from one end of the lining element up to the location where the fasteners are to be, for locking of the fasteners on the rails.

According to a preferred embodiment of the system of the invention, each rail is provided with an indentation over at least one of the two edges thereof serving as line of support for the teeth of the fasteners, such as to ensure an accurate and constant positioning of the fasteners, locked onto the rails, the ones in relation to the others and, whence, of the lining elements into which the fasteners are inserted. In this particular case, the exact positioning is obtained by mere locking of the fastener teeth between the teeth of the rail indentation, the rail indentation teeth being correspondingly aligned.

BRIEF DESCRIPTION OF THE DRAWINGS

The invention as well as various advantages thereof will be better understood from the non-limitative description that follows of a preferred embodiment having reference to the appended drawing wherein:

FIG. 4 is a top view of a portion of a rail of the system according to the invention;

FIG. 5 is a bottom view of a portion of a rail of the system according to the invention with a plurality of fasteners fixed thereto;

FIGS. 6*a* to 6*d* are transverse cross-sectional views of various types of lining elements useable in the system according to the invention.

DESCRIPTION OF THE PREFERRED EMBODIMENT

Figure 1:
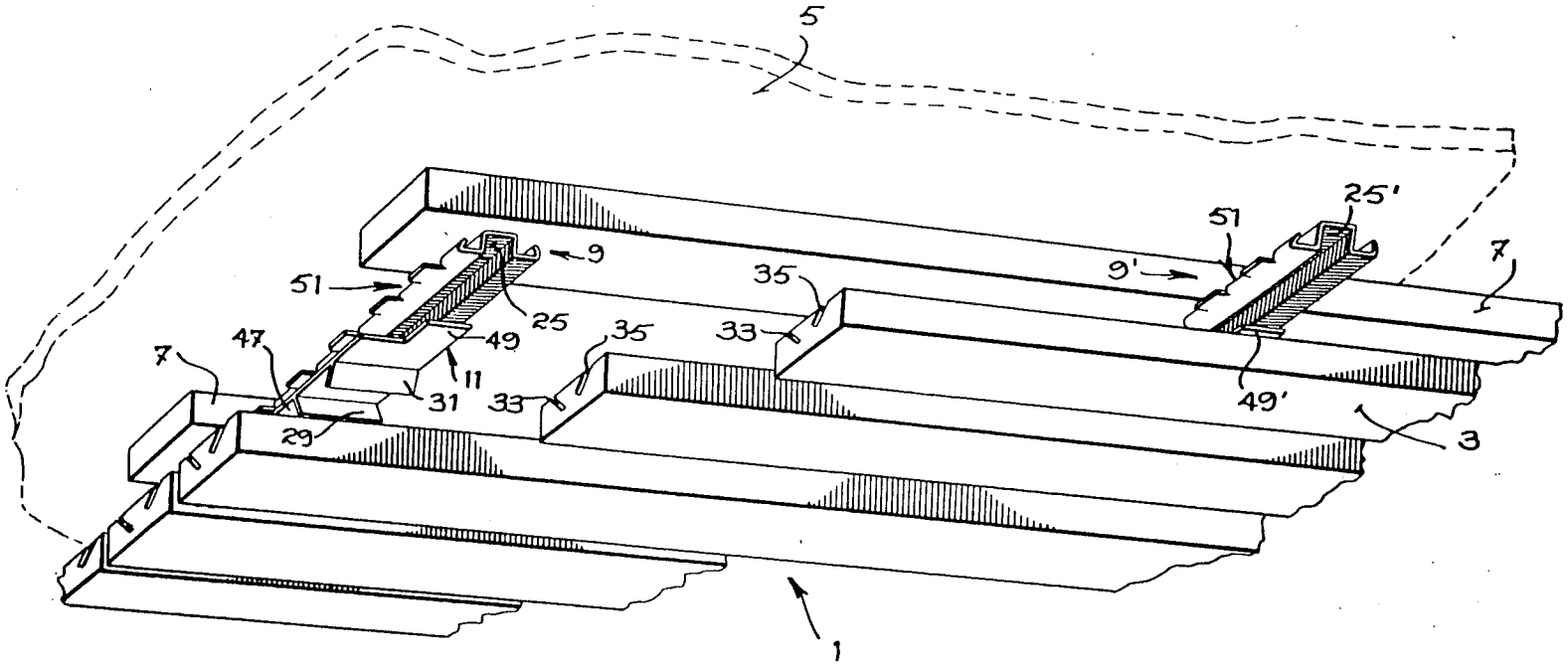
FIG. 1 is a perspective view, partially broken away, of a lining system according to the invention.

The system 1, illustrated in the appended figures, is especially conceived for removably fixing a plurality of identical parallel lining elements 3 on a bearing surface 5 such as a wall or ceiling to line or finish it in a simple and prompt manner. The system 1 comprises at least two identical rails 9 and 9' intended to be secured or suspended in parallel relationship directly to the carrying surface 5 or through wooden members or beams 7, such as illustrated in FIG. 1, the wooden members or beams themselves being fixed or suspended to the carrying surface 5. This type of mounting through the intermediary of wood members or beams 7 is particularly advantageous to the extent that it allows the system to be used for the construction of a false ceiling hanging from the true ceiling of a room.

The rails 9 and 9' are identical, only one of which will consequently be described in detail hereinafter.

Figure 2:
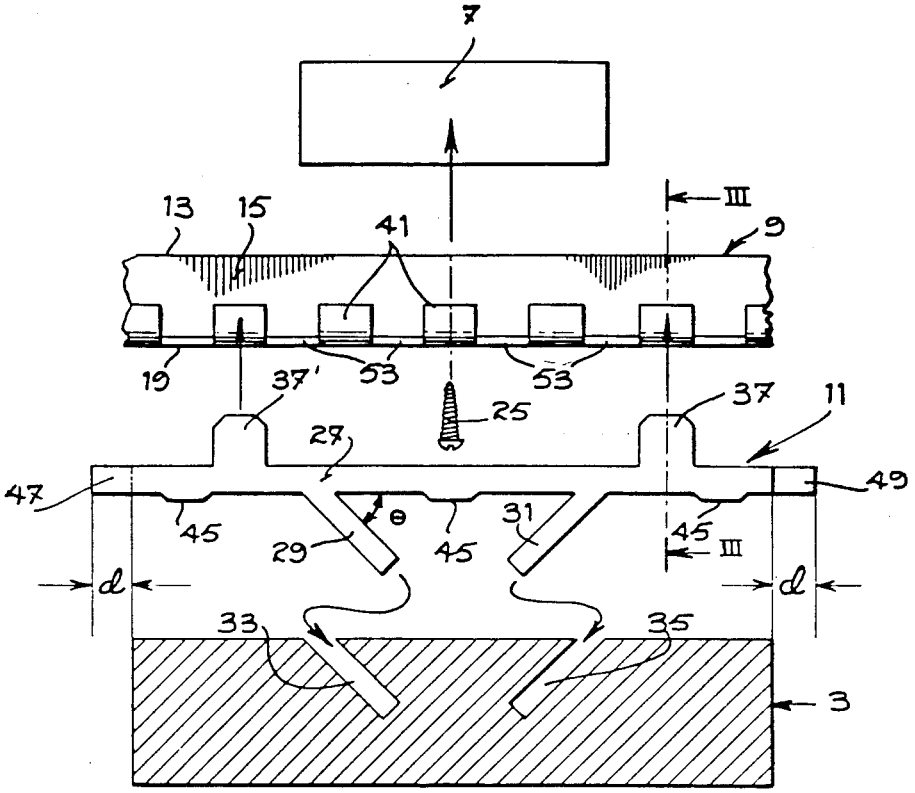
FIG. 2 is an exploded side elevation view showing the manner in which one of the lining elements of the system illustrated in FIG. 1 is secured.
Figure 3:
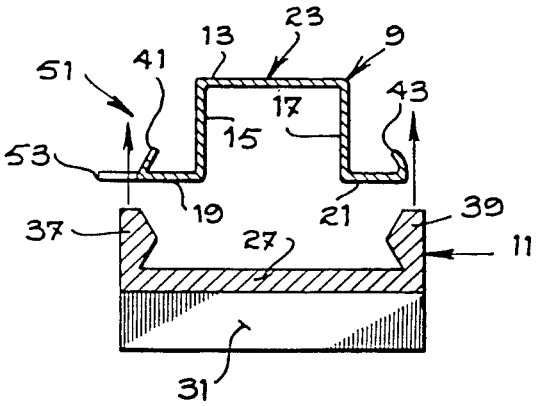
FIG. 3 is a transverse cross-sectional view showing the manner in which a fastener may be locked onto one of the rails of the system according to the invention.

As shown in FIGS. 2 to 4, the rail 9 is preferably made of rolled steel sheet having, when viewed in cross-section, a generally inverted U-shape of which the ends of the legs 15 and 17 are folded outwardly at right angles to define two parallel flanges 19 and 21 intended to serve as lines of support. The rail 9 is provided of a plurality of holes 23 pierced through the web 13 and evenly spaced along its full length to allow it to be secured by means of screws 25 or by any other similar means to the surface 5 to be lined or to wooden members or beams 7. The holes 23 are advantageously spaced one inch apart to facilitate securing the rail 9 to the carrying surface to be lined. They may also serve for suspending the rail by means of metal wires or hooks of adjustable length secured to the carrying surface 5.

The system 1 has a set of fasteners 11 intended to cooperate with the rails 9 to secure the lining elements 3 to the beams 7. The fasteners 11 are all alike so that only one of them will now be described.

The fastener 11 illustrated in FIGS. 1, 2 and 3 comes in one piece and may be made of NYLON or DELRIN (trade marks) by injection molding. It is constituted by a rectangular thin plate 27 having, on one of its faces, two fastening tongues 29 and 31 intended to be inserted into two corresponding grooves 33 and 35 provided on the lining element 3, on the side of the latter opposed to that remaining visible. As illustrated in FIGS. 2 and 3, the fastening tongues 29 and 31 extend transversely of the longitudinal axis of the rectangular plate 27 and over its full width. These two fastenings tongues 29 and 31 extend also obliquely one toward the other to thus define a sort of gripper which, once inserted into the corresponding grooves 33 and 35 of the lining element 3, by nesting or sliding action from one end of the element 3 in question up to where the fastener must finally be located, ensures safe holding of the element 3 without the necessity of using any other securing or supporting means.

It is of course to be understood that in order to accommodate the tongues 29 and 31 of each of the fasteners 11, each element 3 must have corresponding grooves 33 and 35 that extend over their full length or a major portion thereof starting at least from one of its ends.

As shown in FIG. 2, the angle $\frac{1}{4}$ of inclination of the tongues 29 and 31 with respect to the surface of the plate 27 may be in the order of 60°, although any other angle allowing to obtain the desired gripping action may be selected.

Although the most simple and efficient embodiment of the invention be in the use of two tongues as illustrated, the same system may also use fasteners 11 having only one tongue shaped as an L. It will however be understood that, in such a case, the making of the corresponding groove in the lining element 3 may end up to be far more complicated particularly when the lining element is solid. This embodiment with a single fastening tongue may however be found to be an interesting alternative when the lining element 3 is made of extruded plastic or aluminum since, in such a case, it will be relatively simple to foresee a fastener capable of cooperating with the single groove of the element 3.

The thin plate fastener 11 is also provided, on the other face, with means capable of locking, in a reversible manner by simple pressure, on the rail 9.

As illustrated in FIGS. 2 and 3, the means in question are advantageously constituted by one or several pairs of teeth 37, 39, disposed and spaced in such a manner as being simultaneously capable of locking onto the edges of the two parallel flanges 19 and 21 of rail 9.

As shown, each fastener 11 preferably comprises two pairs of teeth 37, 39, respectively disposed along each side of the rectangular plate 27 in order to secure the latter at two points on the same rail 9 in order that the longitudinal axis of the plate 27 be aligned with that of the rail 9. Such an arrangement makes it possible for the lining element 3 to be secured to the rails 9 perpendicularly to the latter, such as clearly illustrated in FIG. 1.

Each of the teeth 37 or 39 is preferably conceived in such a manner as to have the required resiliency to be removably locked by mere pressure onto the outer edges of the flanges 19 and 21. In order to facilitate this insertion or removal, the surface of the teeth 37 or 39, intended to come in contact with the edges of the flanges 19 and 21 may be made in such a way as to have, when viewed in cross-section, the general profile of a flat triangle as shown in FIG. 3. In order to avoid that the teeth 37, 39, be damaged in use, the outer edges of the flanges 19 and 20 may likewise be folded and rounded upon themselves as at 41 and 43, such as shown in FIG. 3. Such a locking arrangement being well known in itself, no additional description of its operation need be given hereinafter.

In order to strengthen to a maximum the plate 27 that makes up the fastener 11, one or several reinforcing ribs 45 may be provided. These ribs 45 may extend transversely of the plate 27 over the full width thereof such as shown by way of example in FIG. 2. An appropriate choice in the height of these ribs may allow them to serve as guide for the positioning and holding of the lining element 3 in a plane parallel to that of the rectangular plate 27.

As can now be understood, each lining element 3 may be secured in an extremely simple, rapid and removable manner to the two rails 9 and 9' which are secured in parallel relation to one another directly or indirectly to the carrying surface 5 to be lined or finished. For that, it is sufficient to insert two fasteners 11 into the grooves 33 and 35 of the element 3 and to slide them until their teeth 37, 39, come beneath the rails 9 and 9'. The mounting of the element 3 is then achieved simply by a light pressure on them at the level of each rail in order to lock the teeth 37, 39, to the rails.

As will easily be gathered, there may be more than two rails 9, 9', if desired. The number of fasteners 11 that will then be required will of course be equal to the number of rails.

The fasteners 11 once inserted into the grooves 33 and 35, being displaceable at will by mere sliding action, it is advantageous to provide visual means that may allow the assembly man to find out easily where the fasteners are located once they are so inserted in order to be able to bring them in facing relation with the rails to which they are to be locked.

The visual means in question may be constituted by two small positions indicating lugs 47 and 49 integrally projecting from the ends of the plate 27, which is the base of each fastener 11. In order to be efficient, the lugs 47 and 49 must have a length sufficient for them to project slightly away from the edges of the lining element 3 when the latter has the fastener 11 mounted thereon whereby to afford a visual indication of the presence of the fastener along each edge of the element 3 (see FIG. 1, element 49').

The positioning lugs 47 and 49 also extend over only half the width of the plate 27 and are staggered with respect to the longitudinal axis thereof. This particular arrangement allows the lugs 47, 49, not only to serve as position indicators but also as abutment for the exact positioning of an adjacent similar fastener mounted over the same rail.

In order to ensure accurate and constant positioning of the lining elements at equal distance to one another, each rail 9 is appropriately provided with an indentation 51 made on at least one of its flanges, such as flange 19. This indentation may easily be provided by cutting, at equal intervals, the edge of the flange 19 and by folding every second zone thus formed. This manner of proceeding makes it possible simultaneously to made the teeth 53 of the indentation 51 and to produce the bent round edge 41 of the flange 19 over which the teeth 37 and 37' lock. The teeth 53 of the indentation 51, beneath which the teeth 37 and 39 of the fasteners 11 lock, ensure that the fasteners 11 are accurately and constantly positioned in relation to one another, the same applying to the lining elements 3 into which the fasteners 11 are inserted. Of course, this type of adjustment implies, in order to be efficient, that the teeth 53 of the indentations 51 of the rails 9 and 9' be correspondingly aligned on parallel lines perpendicular to the parallel axes of the rails 9 and 9'. This positioning of the rails 9 and 9' such that they be perfectly parallel and have their indentation correspondingly aligned is in fact the sole operation of the whole installation which requires a particular care.

As shown in FIGS. 1 and 2, the lining elements 3 may be in the form of simple slats of rectangular cross-section made of plywood or agglomerated wood particles through which the grooves 33 and 35 are made. The slats may have from two to five inches in width for a thickness in the order of $\frac{5}{8}$ of an inch.

As illustrated in FIG. 6*a*, the lining element 3*a* may be in the form of a solid wood slat provided with a rabbet at one end and a tongue at the other end engaging in a rabbet of an adjacent lining element 3*a*, during assembly.

The lining elements 3 shown in FIGS. 6*b* to 6*d* may also be made of ABS or PVC plastic material, or else of extruded anodized aluminum. In the latter case, rather than providing for grooves, one may resort to two tongues 33*b* to *d* and 35*b* to 35*d* as the case may be, intended to be inserted and bear against the fastening tongues 29, 31, of the fasteners 11, such as illustrated in broken lines in FIG. 6*b*. It should thus be understood that, as well in the specification as in the claims appended hereto, the word <groove> used to designate the means in which the fastening tongues of the fasteners are inserted likewise includes the tongues 33 and 35 illustrated in FIGS. 6*b* to 6*d*, which tongues are extruded at the same time as the lining elements 3.

The use of wooden lining elements, eventually coated with a melamine coat is particularly interesting since wood is a low cost and very strong material which is particularly appropriate for lining walls. Lining elements made in the form of rolled extruded steel are light and come into a wide variety of colours and finish. This particular type of lining elements is mostly appropriate for ceilings where stiffness is not as important.

The installation of the lining system above described may be carried out in two steps, as follows.

In one step, the rails are placed in position. During this operation, it is recommanded first to ensure that the teeth of the rails are accurately aligned, that they are parallel and that the carrying surface is appropriately flat (wall or ceiling). If necessary, wooden wedges may be used to correct imperfections. In the case where lining elements for walls have to be vertically oriented, this implying that the rails are to be placed horizontally, it is necessary to provide at the level of the inward end of the slats, a steel angle or a wooden slat over which the lining elements will rest.

In practice, the spacing between rails 9, 9', will be approximately 32".

In the case of a suspended ceiling, the even spacing between the rails hooked onto wires may be obtained by the temporary installation of a limited number of lining elements at 6' to 8' intervals. These elements will be removed as the lining installation of the ceiling proceeds.

Mounting of the lining elements 3 takes place during the second step.

To start off, as many fasteners 11 are inserted in the grooves 33, 35, of a slat, as there are rails 9 which are covered by the slats. The first fastener 11 is then slid into position and mounted on the extreme rail 9 while supporting the ends of the lining element 3. The next fastener 11 is then slid into position and mounted on the adjacent rail 9, and so forth. The other lining elements 3 are installed in the same manner. The final positioning of the fasteners and of the lining elements takes place by displacing them along the rails until the positioning lug at one end of a fastener comes against the corresponding positioning lug of the preceding fastener already in position. In this manner, a very accurate positioning can be obtained.

The lining system according to the invention offers great flexibility. Additionally, the wide variety of available materials and finish as well as ease of installation which characterizes it makes it an original product.

It goes without saying that various modifications may be brought to the embodiment and variants that have just been described without departing from the essence of the invention as defined in the appended claims.

Figure 7:
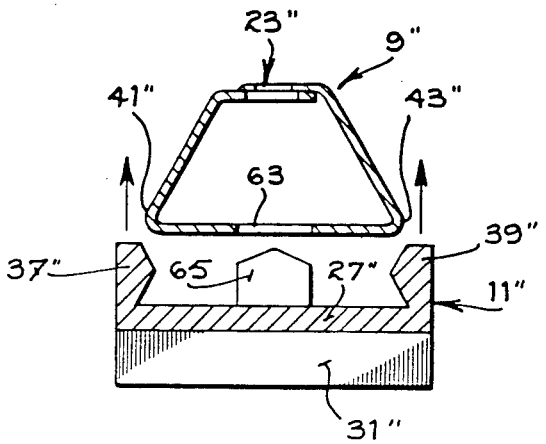
FIG. 7 is a view identical to that of FIG. 3 but showing a possible variant.

By way of example, a rail having a different shape could be used as well as a different abutment and reference system for positioning the fasteners, such as illustrated in FIG. 7. In the latter, the same element as those described previously will be numbered similarly but with the addition of the mark second (″).

As can be seen, the rail 9″ made of steel sheet bent upon itself has, in cross-section, the general shape of an isosceles trapezium with rounded angles. The lower angles 41″ and 43″ of the rail 9″ serve to receive the teeth 37″ and 39″ securing the thin plate 27″ forming the body of the fastener 11″. The rail has, through its upper wall, a plurality of holes 23″ evenly spaced along its full length to allow securing by means of screws (not shown). To allow a perfect positioning of the fasteners 11″, the rail 9″ is also provided with a plurality of evenly spaced holes 63 over the full length of its lower face. These holes are intended to receive positioning lugs 65 extending vertically at the center of each plate 27″. As can be seen, this arrangement of holes 63 and lugs 65 operate in the same manner and gives the same result as the arrangement with teeth 53 of rails 9.

I claim:

1. A one-piece fastener for adjustably and releasably securing a lining element to a carrying surface to be lined or finished, said fastened comprising a thin plate rectangular in shape having, on one face thereof, two fastening tongues extending obliquely from said one face plate in two opposite directions for insertion into two corresponding oblique grooves provided in the lining element for securing and holding said lining element, said two fastening tongues extending transversely of the longitudinal axis of said rectangular plate over the full width thereof and being inclined toward one another, said thin plate having on the other face thereof, means capable of reversibly locking said plate by simply pressing said plate on and against a rail rigidly fixed to the carrying surface to be lined or finished, said reversibly locking means comprising two pair of teeth disposed and spaced from one another so as to simultaneously lock over two parallel edges forming integral parts of the rail, said pairs being symmetrically disposed one on each side of said rectangular plate so as to allow securing said plate at two points on the same rail, the longitudinal axis of said plate being thus aligned with the rail, wherein said thin rectangular plate integrally projects at either end to form small positioning lugs, said lugs each extending over a half-width only of said plate and being staggered with respect to one another so that each lug may serve as a referenced and as abutment for the precise positioning of an adjacent similar fastener over the same rail.

2. A one-piece fastener according to claim 1, characterized in that it comprises at least one reinforcing rib extending transversely of said plate over the full width thereof.

3. A one-piece fastener according to claim 2, characterized in that said fastening tongues make an angle of 60° with respect to said plate.

4. A system for removably securing a plurality of identical parallel lining elements to a carrying surface of the wall or ceiling type for rapidly and simply lining or finishing said surface, said system comprising:

at least two rails adapted to be rigidly fixed in parallel relation to the carrying surface to be lined or finished, each rail having two parallel edges defining two lines of support, and a set of at least two fasteners for each of said lining elements to be secured, the fasteners of each set serving to secure the lining element corresponding thereto to both said rails by mere pressure locking of the respective pairs of teeth thereof on said parallel edges of said rails; each fastener comprising a thin plate rectangular in shape having, on one face thereof, two fastening tongues extending obliquely from said one face plate in two opposite directions for insertion into two corresponding oblique grooves provided in the lining element for securing and holding said lining element, said two fastening tongues extending transversely of the longitudinal axis of said rectangular plate over the full width thereof and being inclined toward one another, said thin plate having on the other face thereof, means capable of reversibly locking said plate by simply pressing said plate on and against a rail rigidly fixed to the carrying surface to be lined or finished said reversibly locking means comprising two pair of teeth disposed and spaced from one another so as to simultaneously lock over two parallel edges forming integral parts of the rail, said pairs being symmetrically disposed one on each side of said rectangular plate so as to allow securing said plate at two points on the same rail, the longitudinal axis of said plate being thus aligned with the rail, the fastening tongues of each fastener being inserted and located into the corresponding grooves of each lining element by fitting or by sliding of said fasteners from one of the ends of the lining element up to the location where the fasteners are to be, for locking thereof on said rails, each rail being provided with an indentation over at least one of the two edges therefor serving as lines of support for said teeth of said fasteners, such as to ensure an accurate and constant positioning of said fasteners with respect to said rails; and, whence, of said lining elements into which said fasteners are inserted, said accurate positioning being obtained by mere locking of said fastener teeth between the teeth of said indentation, said rail indentation teeth being correspondingly aligned.

5. A system as claimed in claim 4, characterized in that said thin rectangular plate of each fastener has a length slightly smaller than the width of said lining element held by said fastener, in that said plate integrally extends lengthwise at each end to form a small positioning lug, said positioning lugs each extending over half the width only of said plate and said positioning lugs being staggered in relation to one another so that each may serve as a reference and as abutment for the precise positioning of an adjacent similar fastener on the same rail, the length of said positioning lugs being sufficient for said lugs to project slightly beyond the side edges of the lining element to thus provide a visual indication of the presence of a fastener of which said lugs are integral

6. A system as claimed in claim 5, characterized in that each rail is generally U-shaped in cross-section with side legs of which the ends are outwardly bent at right angles to define parallel edges serving as lines of support; said rail having, between said legs, a web formed with a plurality of holes evenly spaced over all of the length thereof for securing said rail, with screws or the like, to said carrying surface to be lined.

7. A system as claimed in claim 6, characterized in that:

each rail is made of rolled sheet metal;

each fastener is made of injection molded plastic material; and each lining element is made of wood, extruded plastic material, extruded aluminium or rolled sheet metal.

8. A system as claimed in claim 7 characterized in that said rails are directly secured to said carrying surface through the intermediary of wood pieces secured or suspended to said carrying surface.

9. A system as claimed in claim 7, characterized in that said rails are directly secured to said carrying surface to be lined by means of metal wires or hooks of adjustable length.

* * * * *